US007469794B2

(12) United States Patent
Krueger

(10) Patent No.: US 7,469,794 B2
(45) Date of Patent: Dec. 30, 2008

(54) CHILD RESISTANT CONTAINER-CLOSURE ASSEMBLY

(76) Inventor: David Krueger, 445 Lombardy Rd., Drexel Hill, PA (US) 19026

( * ) Notice: Subject to any disclaimer, the term of this patent is extended or adjusted under 35 U.S.C. 154(b) by 142 days.

(21) Appl. No.: 11/154,200

(22) Filed: Jun. 16, 2005

(65) Prior Publication Data

US 2006/0283831 A1 Dec. 21, 2006

(51) Int. Cl.
*B65D 55/02* (2006.01)

(52) U.S. Cl. ..... 215/218; 215/330; 215/331; 215/217; 215/DIG. 34; 220/288

(58) Field of Classification Search ..... 215/330, 215/331, 332, 337, 338, 349, 217, 218; 220/DIG. 34, 220/288

See application file for complete search history.

(56) References Cited

U.S. PATENT DOCUMENTS

| | | | | | |
|---|---|---|---|---|---|
| 3,339,770 | A * | 9/1967 | Weigand | 215/214 |
| 3,567,057 | A * | 3/1971 | Landen | 215/221 |
| 3,659,735 | A * | 5/1972 | Landen | 215/222 |
| 3,979,001 | A * | 9/1976 | Bogert | 215/217 |
| 4,032,028 | A * | 6/1977 | Reiss et al. | 215/217 |
| 4,387,817 | A * | 6/1983 | Wiles et al. | 215/217 |
| 4,763,804 | A * | 8/1988 | O'Connell | 215/307 |
| 6,006,930 | A * | 12/1999 | Dreyer et al. | 215/44 |
| 6,848,590 | B2 * | 2/2005 | Brozell et al. | 215/220 |
| 7,165,692 | B2 * | 1/2007 | Konefal et al. | 215/220 |
| 2003/0121877 | A1 * | 7/2003 | Brozell et al. | 215/220 |
| 2003/0146185 | A1 * | 8/2003 | Francois et al. | 215/330 |
| 2003/0160020 | A1 * | 8/2003 | Oh | 215/330 |
| 2007/0034595 | A1 * | 2/2007 | Foster et al. | 215/330 |

* cited by examiner

*Primary Examiner*—Anthony D Stashick
*Assistant Examiner*—Christopher B McKinley
(74) *Attorney, Agent, or Firm*—Eugene E. Renz, Jr., PC

(57) ABSTRACT

A container closure assembly comprising a container having a finish and external threads and a cup-like cap having a top and a depending circumferentially extending skirt having second internal threads engagable with the container threads. Detents are providing on one of said threads to normally prevent rotation of the cap in a direction to remove it from the container. First and second interengaging members are formed integrally with the cap and container. One of the interengaging members is flexible to bias the cap in an upward direction to maintain the threads in engagement when the cap is seated on the container. Displacement of the cap downwardly against the normal bias of the interengaging means displaces the cap and container threads to disengage the detents to permit rotation of the cap in a direction to remove it from the container.

6 Claims, 9 Drawing Sheets

CHILD RESISTANT CONTAINER-CLOSURE ASSEMBLY

FIELD OF THE INVENTION

The present invention relates to child resistant tamper evident closure assemblies and more specifically to a novel improvement in assemblies of this type which is easy and economical to manufacture and truly effective for the purposes intended.

BACKGROUND OF THE INVENTION

Child resistant tamper proof container-closure assemblies are not new per se. For example, in U.S. Pat. No. 3,888,376 entitled SAFETY CLOSURE CAP FOR CONTAINERS, the cap has a depending skirt having internal spiral threads which cooperate with threads on the bottle finish to permit application and removal of the cap. The threads have inter-engaging shoulders which permit rotation of the cap to apply it to the container and interengage to normally lock the container against rotation in a direction to remove it. The cap has a resilient liner so that when it is desired to remove the cap, the user applies a downward force against the top compressing the resilient liner and moving the cap axially downwardly on the neck to displace the interengaging shoulders and permit turning of the cap in a direction to remove it.

The safety closure shown in the Cook, U.S. Pat. No. 3,952, 899 issued Apr. 27, 1976 and entitled SAFETY CLOSURE CAP shows a similar arrangement utilizing a compressible liner on the inside of the top of the cap for the cap biasing force.

The Wiles, et al U.S. Pat. No. 4,387,817 issued Jun. 14, 1983, and entitled CHILD RESISTANT CONTAINER COVER also shows a child resistant tamper evident container-closure. There are a series of circumferentially equispaced harpoon shaped threads each having an arrow head portion generally parallel to the center line of the closure and designed to interlock with a series of spiral thread portions on the bottle finish when the cap is threaded to apply it to the container. The arrow head portion 11 locks with the threads in the manner shown in FIG. 2 and much like the Cook assemblies discussed above, can be disengaged by pressing the cap axially downwardly against the bias of a liner made of a suitable resilient material.

The child resistant closure assembly shown in the Steiner, U.S. Pat. No. 4,522,307 issued Jun. 11, 1985 entitled CHILD RESISTANT TAMPER EVIDENT CLOSURE comprises an outer closure shell having an integral tamper evident band encircling and attached to the lower edge of the closure cap skirt and an inner shell having threads for engaging the container threads and including a sealing gasket. Cooperating rachet means are provided on the inner and outer shells which need to be engaged to turn the outer shell in a direction for removal of the inner shell from the container. The tamper evident band which includes a downwardly extending projection prevents this movement so that the band must be either removed prior to closure removal or it will be automatically torn loose as a result of the necessary squeezing action for removal. In either case tearing of the band indicates that an attempt was made to remove the cap. This provides a visual means for determining whether there has been any tampering of the cap seal.

In the Montgomery U.S. Pat. No. 4,682,700 for SAFETY CLOSURE AND CONTAINER PACKAGE, the bottle finish and skirt of the container cap have complementary screw threads. The cap has an inwardly directed circumferentially extending retention bead 28 which on application of the cap over the container retention bead 28 slips axially downward on upper flange surface 38 and is gradually expanded as it approaches the flange apex. Continued rotation compresses gasket 18 between the cap top 20 and lip 42 at the end of the container neck 30. Now when the cap is rotated in a retrograde direction, cap retention bead is forced against the abrupt lower flange surface 40 to resist removal. Enough turning torque must be applied to stretch the cap bead over the apex 36 of the flange which is difficult for children to do and thus provides a tamper resistant feature.

The remaining references listed below are of interest to the extent that they show various cap and container arrangements having a child resistant feature.

Even though the container closure assemblies discussed above are generally suitable for the purposes intended, it has been found that they all share certain disadvantages and drawbacks. For example, it has been found that over a period of use, the liner tends to lose some of its resiliency and this unfavorably impacts the child resistant feature of these assemblies. Furthermore, a number of the embodiments are rather complicated and expensive to manufacture.

| | | |
|---|---|---|
| King | CONTAINER AND CLOSURE | 4,084,717 |
| B. Weigand | CONTAINER CLOSURE | 3,339,770 |
| Gach, et al. | SAFETY CLOSURE | 3,770,153 |
| Cooke | SAFETY CLOSURE CAP | 4,139,112 |
| Bialobrzeski | CONTAINER SAFETY CLOSURE | 4,153,172 |
| Brozell et al. | CHILD-RESISTANT CLOSURE AND CONTAINER PACKAGE | US/2003/0121877 |
| Thompson | CONTAINER AND CAP | 4,856,667 |
| Kusz | CHILD RESISTANT PACKAGE | 5,711,442 |

SUMMARY OF THE INVENTION

With the foregoing in mind, it is an object of the present invention to provide a child resistant container-closure system which is relatively economical to manufacture and assemble and is extremely effective for the purposes intended. Accordingly, the present invention is characterized by novel features of construction and arrangement providing safety to children and yet can be easily manipulated to open and close to access the container by the aged and infirm.

Thus, the assembly comprises a container having a finish and external first thread means and a cup-like cap having a top and a depending circumferentially extending skirt having second internal thread means engagable with said first thread means to facilitate application and removal of the cap from the container and detent means on one of said thread means to normally prevent rotation of the cap in a direction to remove it from the container. First and second interengaging members are formed integrally with the cap and container wherein one of the interengaging members is flexible and flexed when the cap is seated on the container to normally bias the cap in an upward direction to maintain the first and second thread means in engagement and wherein displacement of the cap downwardly against the normal bias of the flexible interengaging member displaces said cap and container threads to disengage the detent to permit rotation of the cap in a direction to remove it from the container.

When the detent means are in engagement, the cap liner is spaced axially from the axial end face of the container to permit downward displacement of the cap against the bias of the flexible member so that the cap threads are no longer obstructed by the detent and the cap can be rotated in a direction to remove it from the container.

Thus, the present invention essentially provides a system comprising cooperative elements formed integrally with the cap and container, one of which is flexible to provide a positive consistent uniform biasing force to retain the cap in a locked, child resistant position instead of the prior art systems which utilize a liner subject to permanent deformation over a period of use which may adversely effect the child resistant aspect of the system. Further, the system of the present invention is economical to manufacture and is totally reliable over the life of the container closure.

DESCRIPTION OF THE PREFERRED EMBODIMENTS

Figure 1:
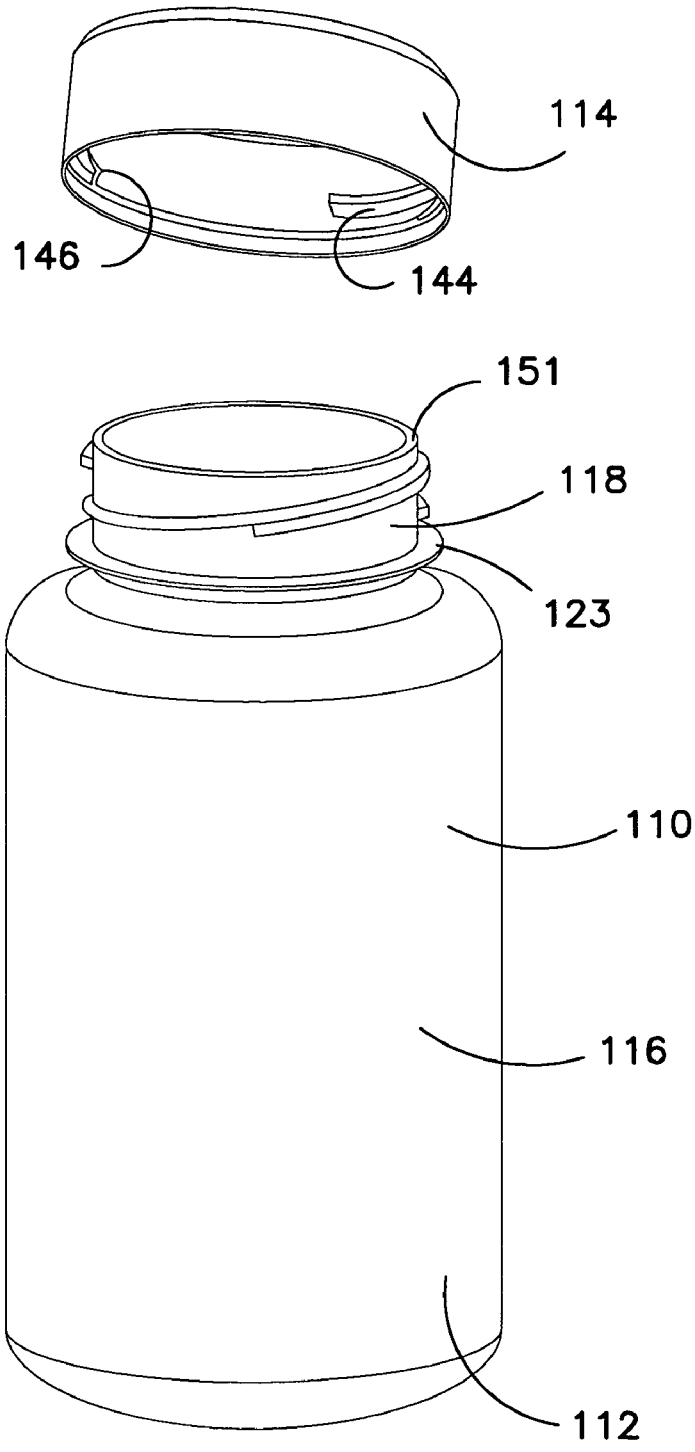
FIG. 1 is a perspective view of the principal embodiment of the present invention.

Referring now to the drawings and particularly to FIG. 1 thereof, there is shown a first embodiment of child resistant container-closure assembly in accordance with the present invention generally designated by the numeral 110. The assembly comprises a container 112 and cap 114 which may be molded of a suitable plastic material.

Figure 5A:
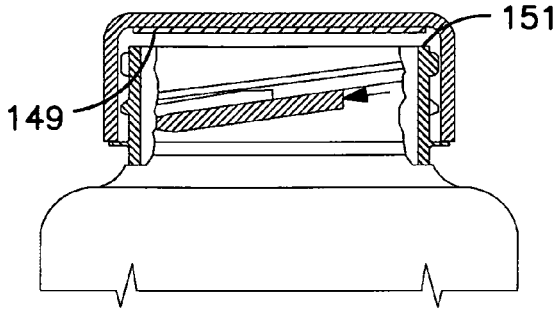
FIG. 5*a* is a sectional view in the early stages of application to the container as indicated by the arrow.
Figure 5B:
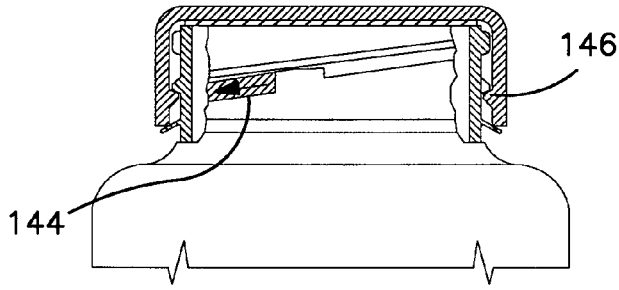
FIG. 5*b* shows the cap fully seated with the liner pressing the axial end face of the bottle finish.

The container 112 has a body portion of generally cylindrical cross section and an upstanding neck portion or bottle finish 118 of smaller diameter. The exterior of the bottle finish 118 has spiral splines, in the present instance, two spline segments 120 and 122. The spline segments 120, 122 extend about half way around the neck of the bottle and each has an enlarged portion 120*a*, 122*a* and a cutback portion 120*b* defining a step configuration and detents 124 and 126 approximately midway of the segments. In accordance with this embodiment of the invention, a circumferentially extending flexible flange 123 extends radially outwardly from the bottle finish 118 below the thread segments 120, 122. The circumferentially extending flange 123 is positioned below a plane P-P through the discharge opening 125 a predetermined height H so that when the cap is turned in a direction to apply it to the container 112 and is almost fully seated, the lower circumferentially extending edge 142*a* of the skirt 142 of the cap engages the flange 123 in the manner shown in FIGS. 3 & 5 and the liner 149 is spaced by a gap G from the axial end face 151 of the bottle finish 118.

Figure 6A:
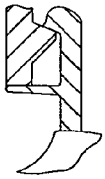
FIG. 6*a* is an enlarged fragmentary sectional view of the portion circled in FIG. 6.
Figure 6:
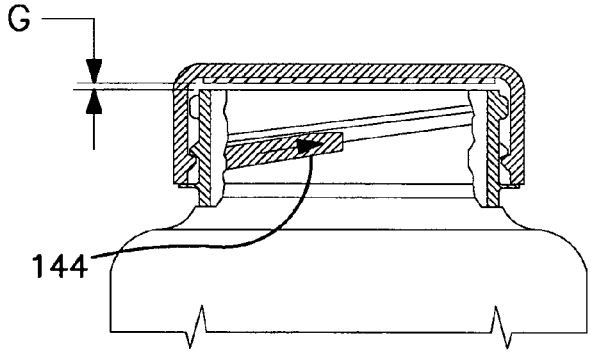
FIG. 6 shows the cap turning in a direction to remove it wherein the cap thread abuts the detent on the container thread and wherein the liner is spaced axially from the axial end of the bottle finish.

Note that in this position one end of the cap thread 144 is adjacent the detent 124 (See FIG. 6). Continued turning of the cap to fully seat it deflects the flexible member 123 downwardly to press the liner 149 to seal with the end face 151 (See FIG. 5A).

Figure 7:
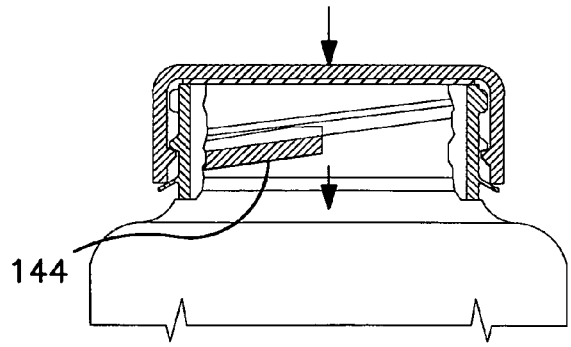
FIG. 7 shows the cap pressed axially downwardly so the cap threads clear the container threads to allow turning the cap in the removal direction.

The cap 114 has a generally circular top 140 and a depending circumferentially extending skirt 142. Spiral splines or threads project inward from the inner face of the skirt 142 and in the present instance comprise two diametrically opposed thread segments 144 and 146 which span an arc of about 90°. Accordingly, when the cap 114 is fully seated on the container, the parts are in the relative position shown in FIG. 5 wherein the finish 118 and the cap threads have been rotated to a position wherein the cap threads are spaced from the detents and the flexible flange 123 is deflected downwardly which normally biases the cap and container threads to an engaging relationship. This arrangement provides an upward biasing force on the cap which maintains the splines or threads of the cap and the container engaged. If now the cap is rotated in an opposite direction as indicated by the arrow in FIG. 6, the cap thread 144 engages the detent 124 and blocks a further removal effort. In this position, however, the cap 114 has been deflected upwardly providing a gap or space G between the axial end face 151 of the container 112 and the cap seal 149. In this position, the cap can be pushed axially downwardly easily against the upward bias of the flange 123 and reclosing the gap G between the container seal 149 so that the cap thread 144 is displaced downwardly to clear the detent 124 and can be turned in a direction to fully remove it from the container (See FIG. 7).

In accordance with a modified version of the embodiment of the invention described above, the flange 123 instead of being continuous about the periphery of the container finish 118 can consist of a plurality of radially outwardly directed tabs which function similarly to the continuous flange to provide the upward biasing force and displacement capability for removal of the cap described above.

Figure 8:
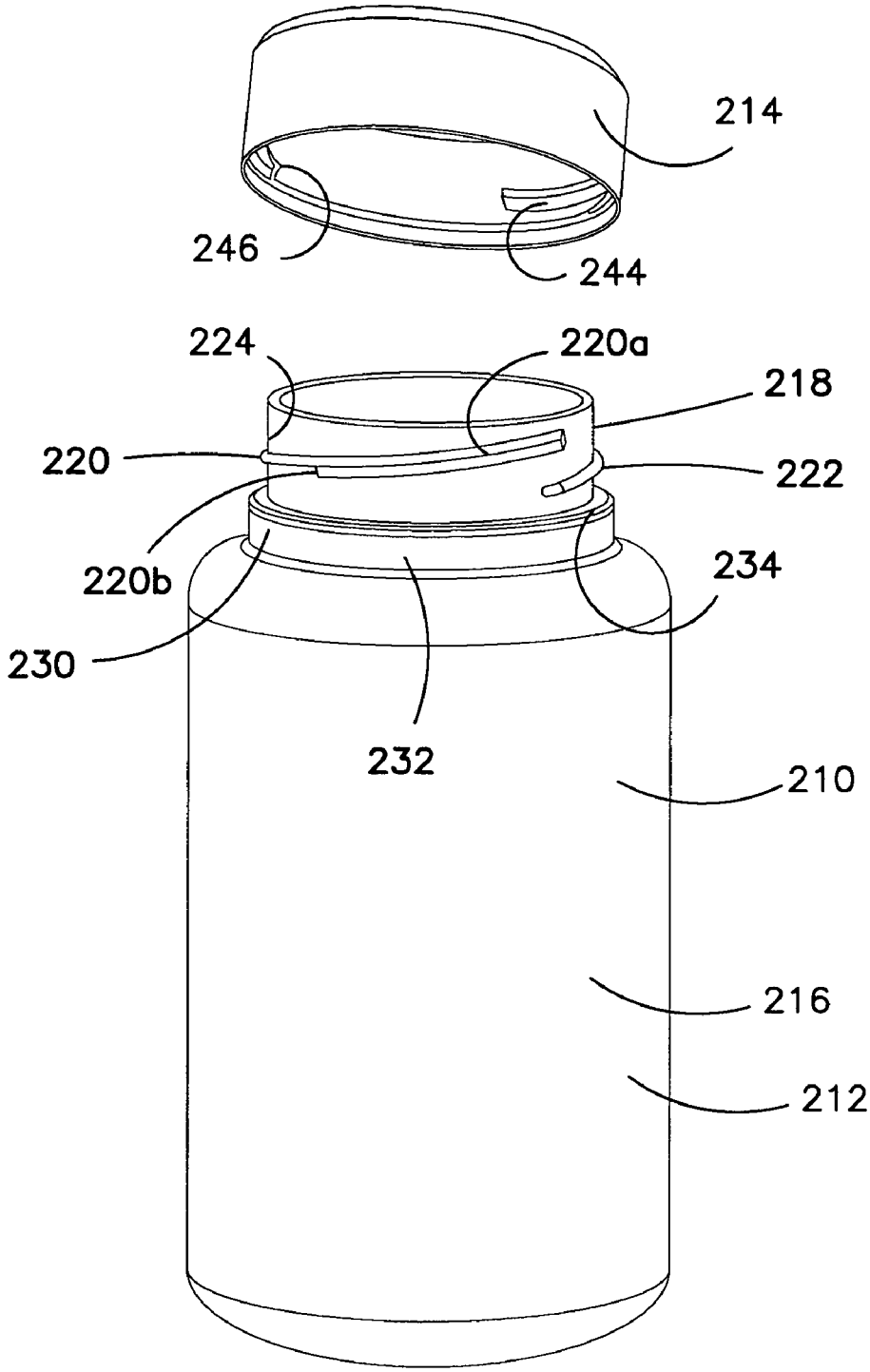
FIG. 8 is a perspective view of another embodiment of container closure assembly in accordance with the present invention.
Figure 10:
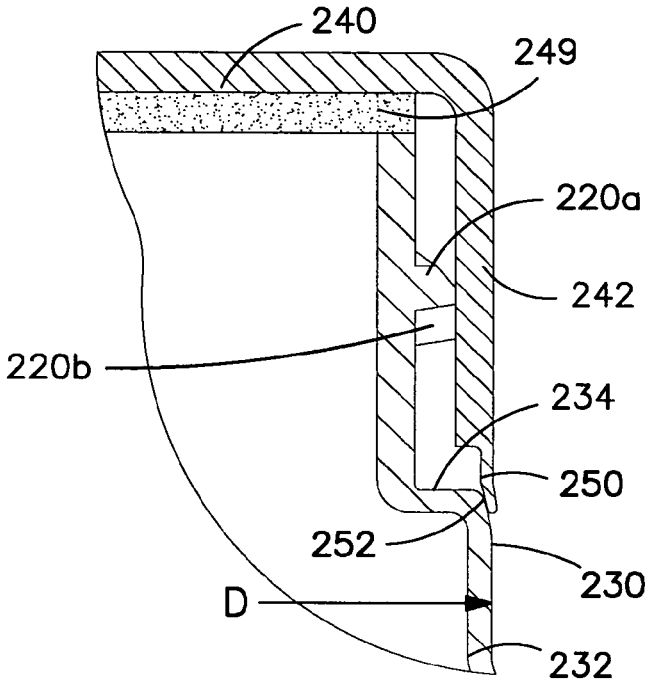
FIG. 10 is an enlarged fragmentary sectional view showing the cap in a fully seated position.
Figure 9:
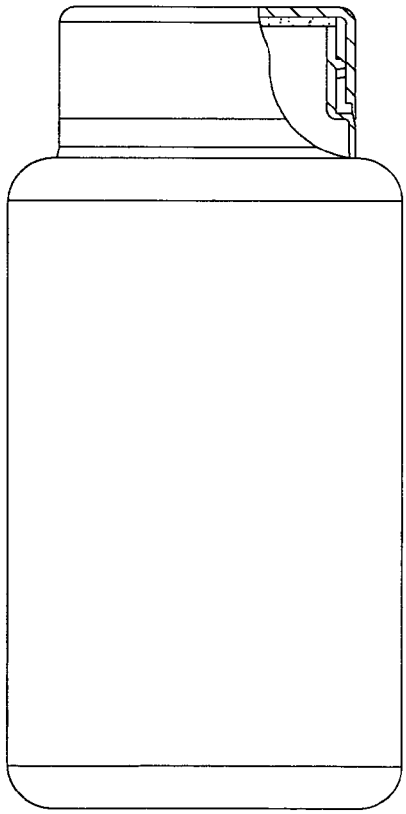
FIG. 9 is a side elevational view of this embodiment with parts of the cap broken away to show the relationship between the cap and the bottle finish.

There is shown in FIGS. 8-10 another embodiment of child resistant container closure assembly in accordance with the present invention generally designated by the numeral 210. The assembly comprises a container 212 and a cap 214 which may be molded of a suitable plastic material. Some of the elements of this assembly are somewhat similar to the previously described embodiment and therefore a 200 series has been established with the last two digits being the same as the counterpart of the first embodiment.

The container 212 as illustrated has a body portion of generally circular cross section and an upstanding neck portion or bottle finish 218 of smaller diameter. The exterior of the bottle finish 218 has spiral splines or threads in the present instance two thread segments 220 and 222. The thread segments 220, 222 extend about half way around the neck of the bottle and each has an enlarged portion 220*a*, 222*a* and a cut back portion 220*b*, 220*b* defining a stepped configuration and a detent 224 and 226 approximately midway of the segments. In the present instance, the container finish 218 includes an offset section 230 comprising an axial wall 232 of a predetermined diameter D and a radial connecting wall 234 for a purpose to be described hereafter.

Figure 3:
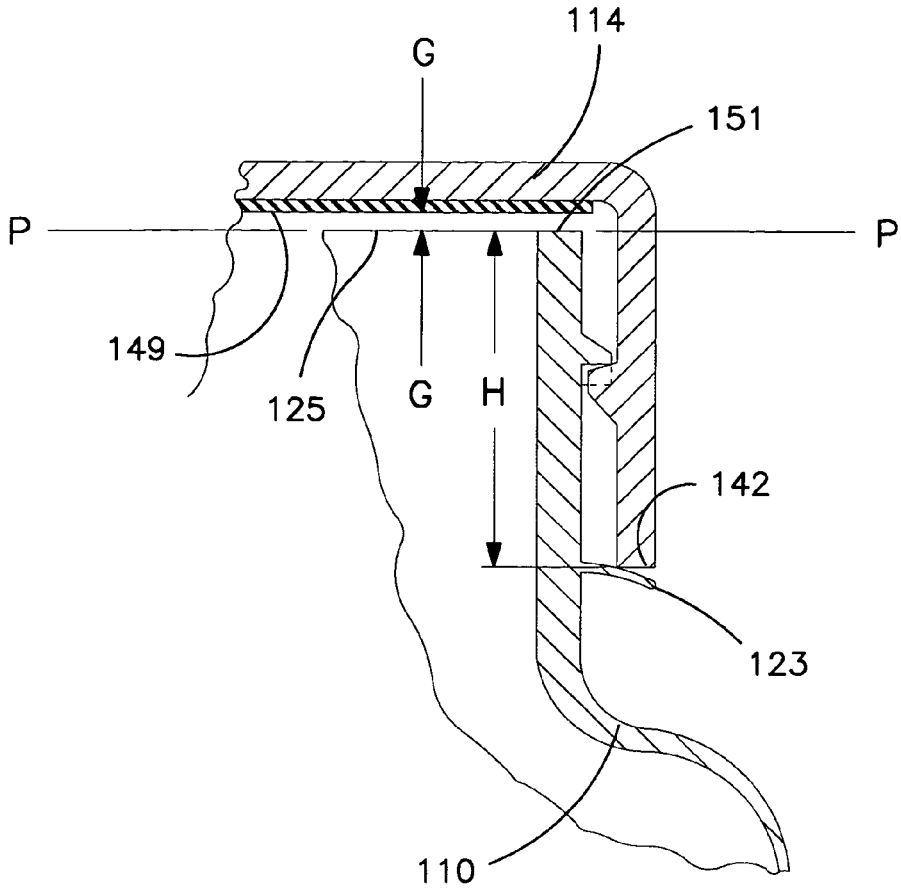
FIG. 3 is an enlarged fragmentary sectional view of broken away portion of FIG. 2.
Figure 2:
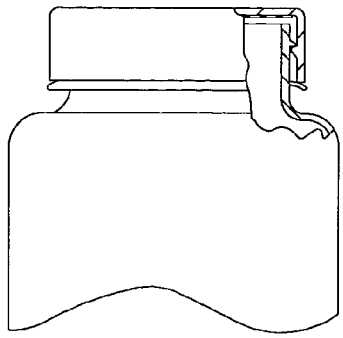
FIG. 2 is a fragmentary view partly in section to show the interengaging elements of the cap and the bottle finish.
Figure 4:
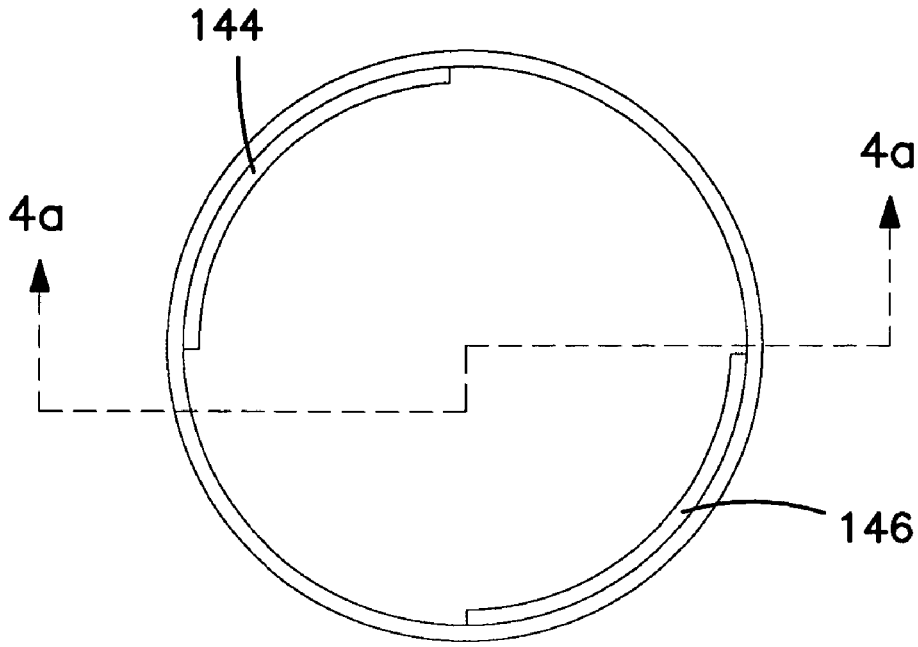
FIG. 4 is a bottom plan view showing the diametrically opposed internal threads on the inside skirt of the cap.
Figure 4A:
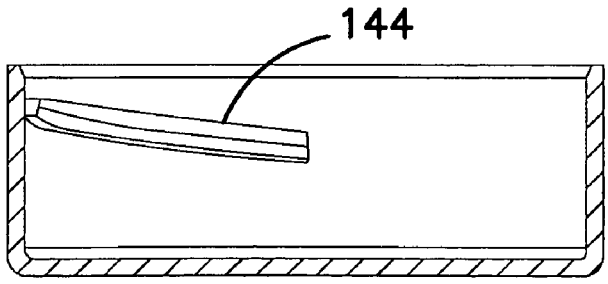
FIG. 4*a* is a sectional view of the cap taken on lines 4*a*-4*a* of FIG. 4.

The cap has a generally circular top 240 and a depending circumferentially extending skirt 242. The spiral splines or threads project inwardly from the skirt 242 and in the present instance comprise two diametrically opposed thread segments 244 and 246. In the present instance the lower terminal edge of the skirt 242 has an axially extending flange 250 of thin cross section having an internal diameter D1 in the relaxed state smaller than the diameter D of the axial wall 232 of the container finish 218 which as illustrated in FIG. 3 is flexed when it engages the rounded or beveled edge 252 connecting the axial and radial wall portions 232 and 234 and provide an upward bias to the cap to maintain engagement of the cap and container splines or threads.

Consider now operation of the container closure assembly of the present invention. When it is desired to seal the contents of the container, the cap is simply positioned over the bottle finish so that the cap threads 244, 246 engage under the splines or threads 220, 222 on the container finish 218. The cap is then rotated in a clockwise direction to a position where the cap threads are displaced angularly to a point where they underlie the container threads and the flexible lip 250 engages the axial wall 232 of the container finish connecting section as shown in FIG. 3. If the cap is now rotated in a counterclockwise direction to remove it, the cap thread segments engage the detent 224 thereby blocking further rotation in a direction to remove the cap. The cap can only be rotated further by pressing the cap against the normal upward bias created by the flexible lip 250 and in this position the cap threads can rotate past the detent 224.

Figure 12:
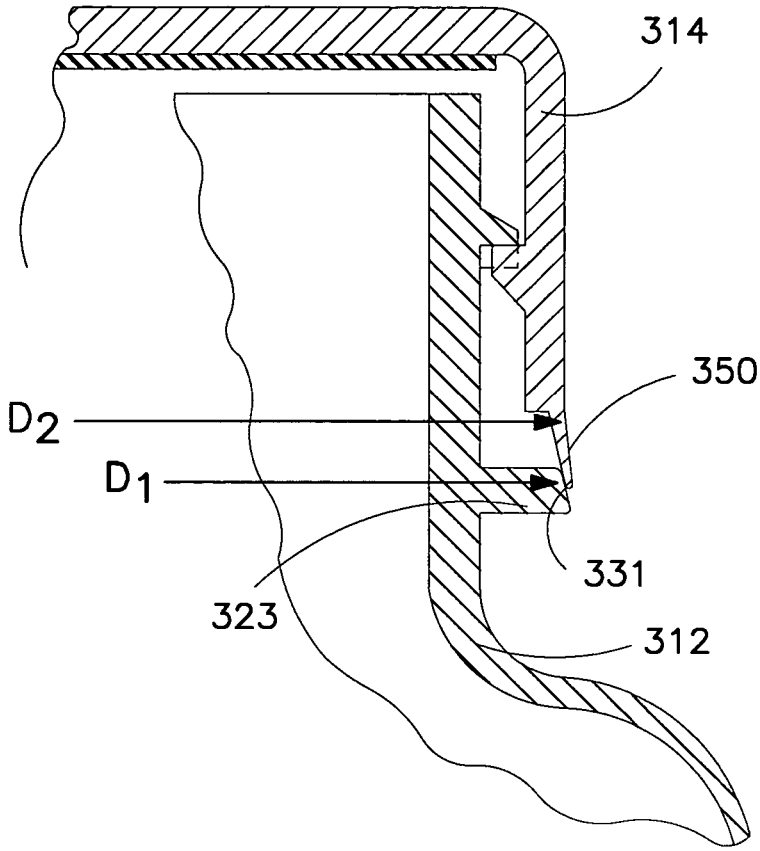
FIG. 12 is an enlarged fragmentary sectional view showing the position of the cap on the container when the cap is turned in a direction to apply it to the container.
Figure 11:
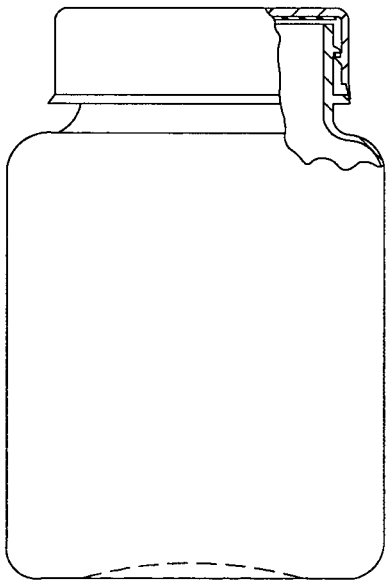
FIG. 11 is a side elelvational view of still another embodiment of child resistant container closure assembly in accordance with the present invention.
Figure 13:
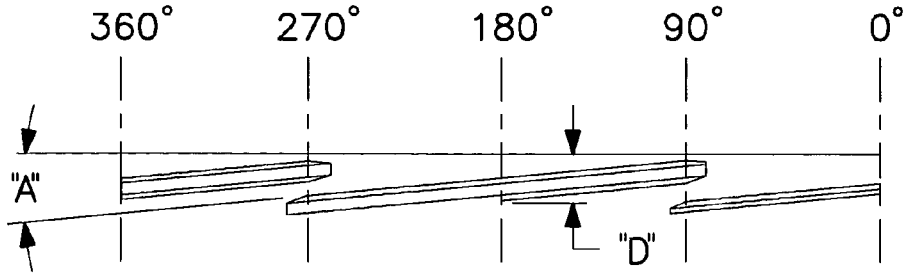
FIG. 13 is a 360° bottle thread development.
Figure 14:
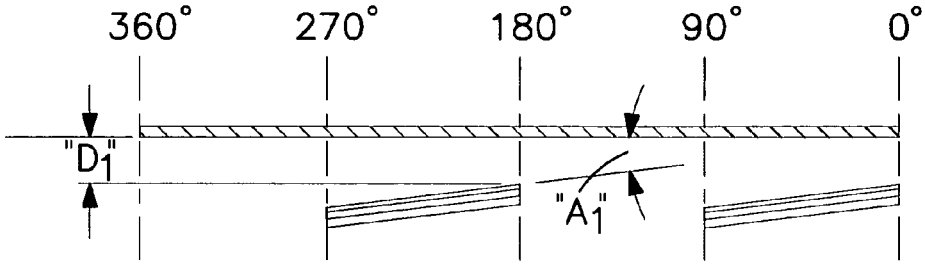
FIG. 14 is a 360° cap thread development.
Figure 15:
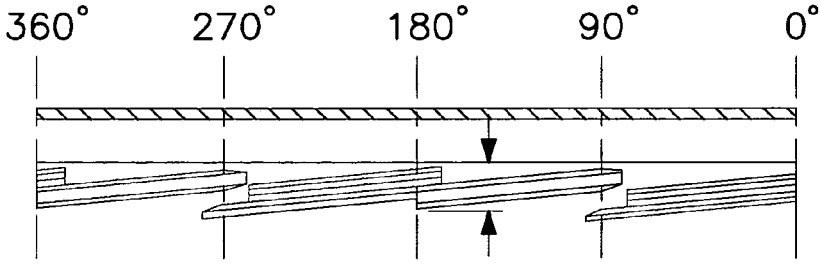
FIG. 15 is a 360° cap and bottle thread development.
Figure 16:
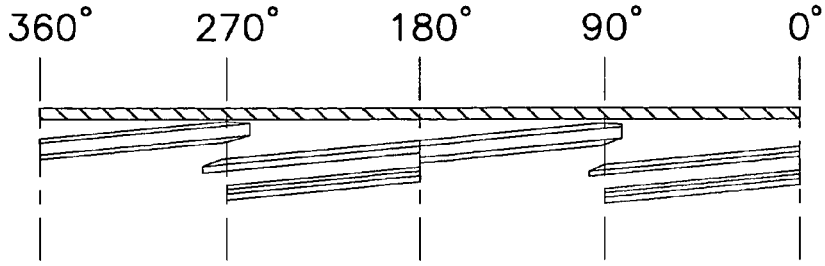
FIG. 16 is a 360° thread development of the cap and bottle as the closure is rotated onto the bottle, the thread on the closure passes the detent on the bottle thread as shown.
Figure 17:
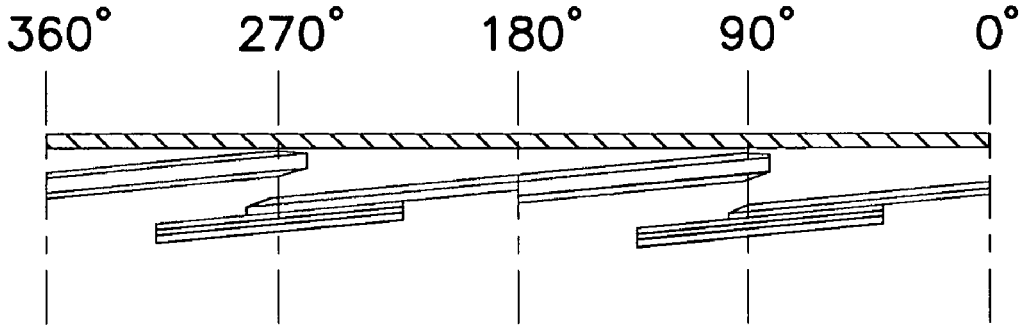
FIG. 17 is a 360° thread development of the cap and bottle showing the relative position of the threads on the closure with respect to the bottle threads when the closure is in the completely torqued down and sealed position.
Figure 18:
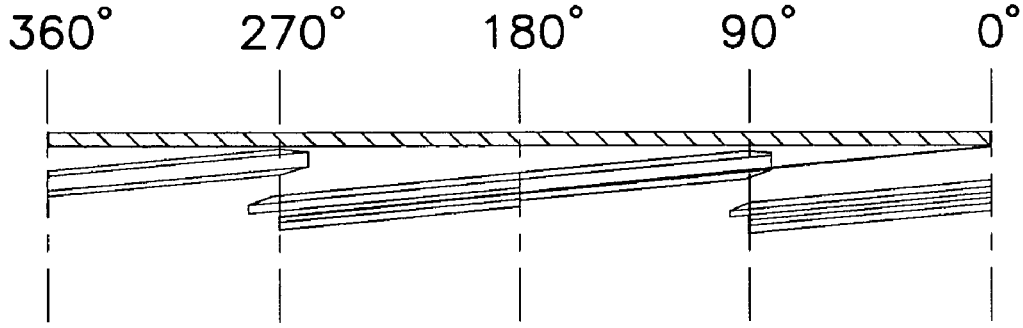
FIG. 18 is a 360° thread development of the cap and bottle as the closure is rotated back from the completely sealed position, the upward bias on the closure forces the closure thread into the locked position which is shown.

There is shown in FIGS. 11 and 12 another embodiment of child resistant closure assembly in accordance with the present invention. Elements or parts of the container or cap which are similar previously describe embodiments are given similar reference numbers in the 300 series. Thus, the cap is designated by the numeral 314 and the container by the numeral 312. In accordance with this embodiment, the container finish is straight sided and a relatively rigid flange 314 is provided spaced axially downwardly from the axial end face of the container finish 318 to a predetermined height H1 so that when the cap is seated on the container, the flexible lip 350 engages the tapered circumferential face 331 of the rib 323 to provide an upwardly directed bias or seating force so that when the cap is rotated in a direction to remove it, the cap threads engage the detents and block removal of the cap. Now when it is desired to remove the cap, the cap is pressed downwardly against the bias provided by the flexible lip 350 of the skirt so that when the cap is rotated the cap threads are not aligned with the detent permitting the cap to be rotated in the direction to remove it.

The disadvantages and drawbacks of the prior systems is that they do not provide a truly hermetic seal and therefore are confined to packaging only products such as pills and are generally not suitable for liquids.

Further, the prior art packages can not be used with a foil induction seal liner because of the lack of pressure applied to the top of the container through the liner.

The prior art closures are applied to the container to the point of engagement and not torqued to a specified force. Thus, they are usually applied by hand not by conventional capping equipment which limits their use.

By contrast, the closure of the present invention is designed to be applied past the locking point to a predetermined torque as described above.

As the closure is turned in a direction to remove it, the detent is engaged because of the upward bias on the closure which is overcome with a downward force on the cap to allow removal. Therefore, the present system is suitable for foil induction seal and provides the necessary tight seal to package liquid products.

Even though particular embodiments of the present invention have been illustrated and described herein, it is not intended to limited the invention and changes and modifications may be made therein within the scope of the following claims:

What is claimed is:

1. A container closure assembly comprising a container having a finish and external first thread segments and a cup-like cap having a top and a depending circumferentially extending skirt having second internal thread segments engageable with said first thread segments to facilitate application and removal of the cap from the container and detent means on one of said thread segments permitting rotation of the cap in a direction to apply the cap to the container to a fully seated sealed position wherein the cap thread has angularly passed the detent on the container thread and allows only limited rotation of the cap in a direction prior to pressing down the cap to remove it from the container, first and second inter-engaging members formed integrally with the cap and container, one of said inter-engaging members being flexible to bias the cap in an upward direction to maintain the first and second thread segments in engagement and wherein displacement of the cap downwardly against the normal bias of the inter-engaging means displaces said cap and container threads to disengage the detent to permit rotation of the cap in a direction to remove it from the container, said cap and container threads being angularly disposed in such a way that when the trailing end of the cap thread passes over the detent on the bottle thread, the cap can be rotated in either direction in a small angular zone between a fully seated sealed position wherein the cap cannot be displaced in an axial direction relative to the container and a removal position wherein the trailing end of the cap thread segment abuts the detent to provide an axial clearance so the cap can be displaced axially downwardly to displace the threads sufficiently to clear the detent and permit rotation of the cap in a direction to remove it from the container.

2. A container-closure assembly as claimed in claim 1 wherein said one flexible member comprises a circumferentially extending flange projecting radially outwardly from the container finish engagable by the lower peripheral edge of the cap skirt to flex the same when said cap is at a lower fully seated limit position.

3. A container-closure assembly as claimed in claim 2 wherein the cap liner is spaced a predetermined distance from the axial end face of the container when the flexible member is initially engaged.

4. A container-closure assembly as claimed in claim 1 wherein said one flexible member comprises a thin circumferentially extending lip formed integrally with the cap skirt which engages a rigid radial projection below the bottle finish engageable by said thin lip to flex it radially outwardly and provide an upward force on the cap.

5. A container closure assembly as claimed in claim 4 wherein said rigid member has a downwardly tapered outer circumferentially extending face and wherein said face has a diameter portion $D_1$ larger than the internal diameter $D_2$ of the flexible lip to produce this flexing action when the cap is applied to the container.

6. A container-closure assembly as claimed in claim 4 wherein the other member has an offset section below the container thread of a diameter D greater than the internal diameter $D_2$ of the flexible lip to provide an upward biasing force when the cap is seated on the container in its lower seated limit position.

* * * * *